US008226371B2

(12) United States Patent
Kochan

(10) Patent No.: US 8,226,371 B2
(45) Date of Patent: Jul. 24, 2012

(54) PUMP CONTROL UNIT WITH DECELEROMETER SWITCH

(75) Inventor: John R. Kochan, Naperville, IL (US)

(73) Assignee: Metropolitan Industries, Inc., Romeoville, IL (US)

( * ) Notice: Subject to any disclaimer, the term of this patent is extended or adjusted under 35 U.S.C. 154(b) by 840 days.

(21) Appl. No.: 12/366,840

(22) Filed: Feb. 6, 2009

(65) Prior Publication Data

US 2009/0201073 A1 Aug. 13, 2009

Related U.S. Application Data

(60) Provisional application No. 61/027,076, filed on Feb. 8, 2008.

(51) Int. Cl.
*F04B 49/04* (2006.01)

(52) U.S. Cl. ..... 417/40

(58) Field of Classification Search ..... 417/126, 417/40–41

See application file for complete search history.

(56) References Cited

U.S. PATENT DOCUMENTS 3,113,285 A * 12/1963 Edwards ..... 367/3
7,307,538 B2 12/2007 Kochan, Jr.

* cited by examiner

*Primary Examiner* — Anh Mai
*Assistant Examiner* — Hana Featherly
(74) *Attorney, Agent, or Firm* — Husch Blackwell LLP

(57) ABSTRACT

A pump control unit incorporates an accelerometer as a sensor. Responsive to outputs from the sensor, electrical load driving signals can be provided to energize a pump motor to reduce a fluid level in an enclosure.

18 Claims, 1 Drawing Sheet

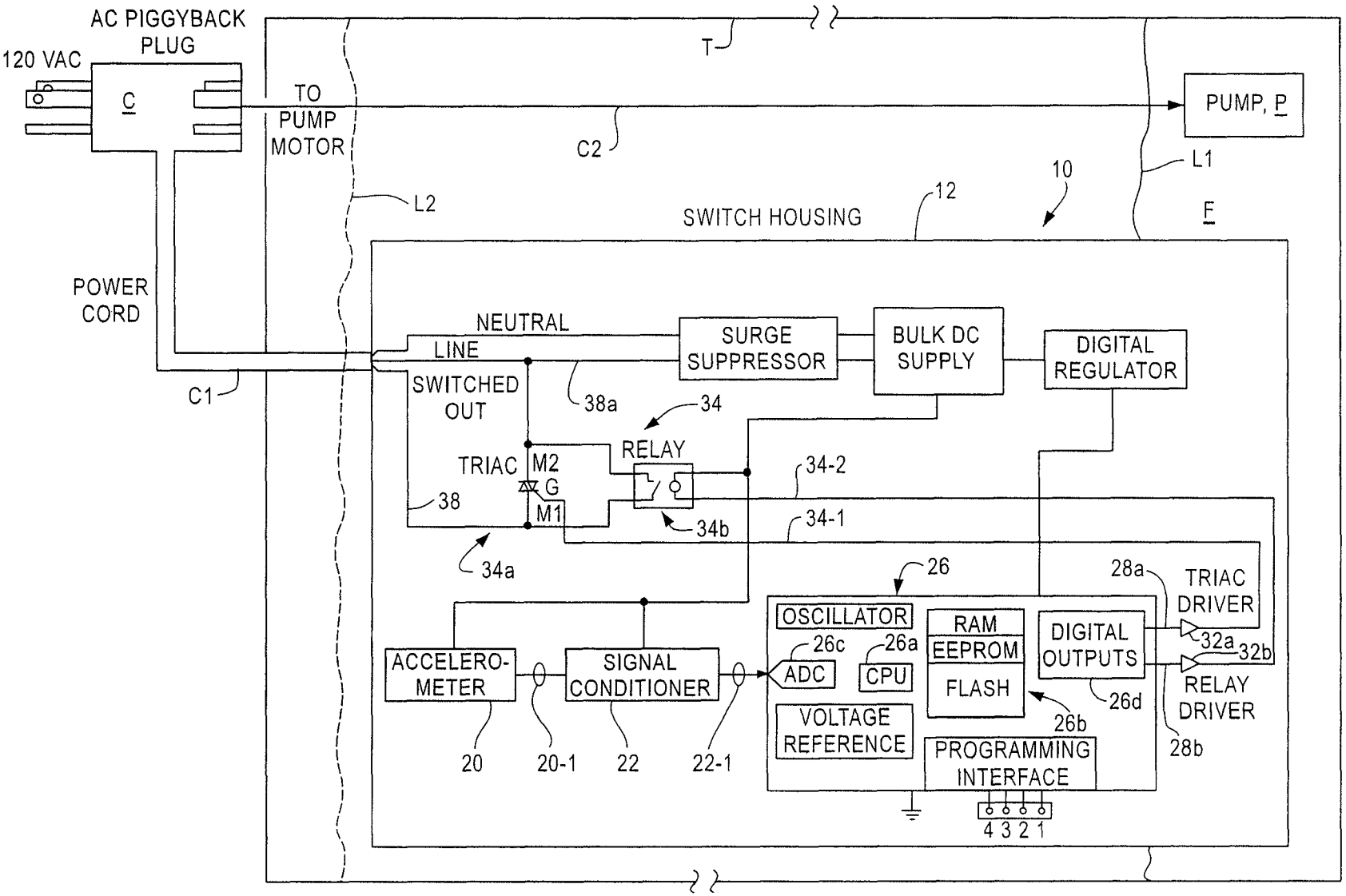
PUMP, P
L1
F
10
12
SWITCH HOUSING
T
C2
L2
TO PUMP MOTOR
AC PIGGYBACK PLUG
C
120 VAC
POWER CORD
C1
DIGITAL REGULATOR
BULK DC SUPPLY
SURGE SUPPRESSOR
NEUTRAL
LINE
SWITCHED OUT
38a
34
RELAY
34b
34-2
34-1
TRIAC
M2
G
M1
38
34a
TRIAC DRIVER
32a
32b
RELAY DRIVER
28a
28b
DIGITAL OUTPUTS
26d
26b
PROGRAMMING INTERFACE
4 3 2 1
RAM
EEPROM
FLASH
26
OSCILLATOR
26a
CPU
26c
ADC
VOLTAGE REFERENCE
22-1
SIGNAL CONDITIONER
22
20-1
ACCELERO-METER
20

PUMP CONTROL UNIT WITH DECELEROMETER SWITCH

CROSS-REFERENCE TO RELATED APPLICATION

This application claims the benefit of the filing date of U.S. Provisional Application Ser. No. 61/027,076 filed Feb. 8, 2008 and entitled "Decelerometer Switch". The '076 application is incorporated herein by reference.

FIELD

The invention pertains to pump control units. More particularly, the invention pertains to control units to turn pumps on and off to maintain fluid levels in a container within predetermined levels.

BACKGROUND

Various types of sump pump on/off switch units are known. One such configuration has been disclosed and claimed in U.S. Pat. No. 7,307,538, entitled Pump Connector System which issued Dec. 11, 2007 and which is assigned to the assignee hereof and incorporated by reference.

While known switches have been effective control elements, they operate in difficult environments and are subject to arcing as well as electrically induced contact erosion where relays are used to switch turn-on/turn-off motor currents. The noted operating conditions can lead to shortened lifetimes and switch failures.

There is thus a continuing need for improved pump on/off switch units.

BRIEF DESCRIPTION OF THE DRAWING

FIG. 1 is a block diagram of a pump control system in accordance with the invention.

DETAILED DESCRIPTION

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the invention incorporate an accelerometer as a sensor of an ambient condition, for example a fluid level. Signals from the sensor can be coupled to control circuits which can generate control output signals to activate an AC switch, and/or a relay. In one aspect of the invention, a solid state switch with a thermal sensor can be used in combination with a non-solid state switch to take into account heating of the semiconductor switch during extended on intervals.

In another aspect of the invention, acceleration sensing elements facilitate solid state switching over any increment in a circle, 360 degrees. Where such pump control units are encased in a float-type housings, they can be configured to move through a spherical locus in response to a fluid level in a tank, for example.

In a further aspect of the invention, the control circuits can incorporate a programmable processor and associated control program stored on a computer readable medium such as read only memory, programmable read only memory without limitation. Switching increments can be established using the pre-stored programs which can incorporate programmable on/off parameters, for example over a 360 degree circle defined on the spherical locus of the respective housing.

FIG. 1 is a block diagram of one embodiment of the present invention. It will be understood that other embodiments come within the spirit and scope of the invention.

In FIG. 1, a motor control unit 10, and an associated pump P are illustrated installed in a tank T of fluid F. The unit 10, and pump P can maintain the fluid F between a selected level L1, or, a level L2 greater than the level L1 as desired.

A sealed, hollow, switch housing 12 can float in the fluid F and change position/orientation in response to the fluid level rising and falling. Housing 12 carries an accelerometer 20 which generates an output signal indicative of movement of housing 12, on line 20-1. Line 20-1 is coupled to a signal conditioner 22 which in turn proves a conditioned version of the accelerometer signal, via line 22-1 to control circuits 26.

Control circuits 26 can include a programmable processor 26*a*, various types of storage units 26*b*, including random access read-write memory, electrically erasable read only memory and flash memory. Units 26*b* provide computer readable storage units which can carry control programs or software, executable by processor 26*a*.

Circuits 26 include one or more input ports, such as an analog input port coupled to line 22-1 which includes an analog-to-digital converter 26*c* which provides digital representations of the signals from sensor 20 to processor 26*a*.

A digital output interface 26*d*, coupled to processor 26*a*, can produce first and second output control signals 28*a,b*. Signals 28*a,b* buffered by amplifiers/drivers 32*a,b*, can in turn be coupled to a motor control switching element 34.

Element 34 can include a solid state switch, such as a Triac 34*a*, and a relay 34*b*, parallel coupled to one another. Control signals, coupled via lines 34-1-2 can be used to switch Triac 34*a* and relay 34*b* into a conducting state to provide a switched output on a line 38.

As those of skill in the art will understand, electrical energy coupled from connector C, via cable C1 and line 38*a* into housing 12 can be provided as a switched output, via line 34*a* cable C1, connector C and cable C2 to pump P thereby activating same to pump fluid F from the tank T down to level L1 for example. In the embodiment of FIG. 1, utility supplied, or locally generated, AC-type electrical energy can be coupled to unit 10 and pump P to activate pump P. In other embodiments, DC-type electrical energy can be coupled to a switching unit, such as unit 10, without departing from the spirit and scope of the invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A pump switch comprising:

a hollow, water resistant float;

an accelerometer carried in the float;

control circuits, carried in the float and coupled to the accelerometer, the control circuits, responsive to an output from the accelerometer, generate at least one control signal and which includes at least one three terminal output device, the control signal is coupled to a terminal of the device.

2. A switch as in claim 1 which includes a second three terminal output device where selected terminals of each output device are connected to one another.

3. A switch as in claim 2 which includes a switched electrical output line extending from the float and coupled to a selected terminal pair of the output devices.

4. A pump switch comprising:

a hollow, water resistant float;

an accelerometer carried in the float;

control circuits, carried in the float and coupled to the accelerometer, the control circuits, responsive to an output from the accelerometer, generate at least one control signal, which includes a switched electrical output coupled to the control signal and which includes at least one three terminal output device, the control signal is coupled to a terminal of the device and to the electrical output.

5. A switch as in claim 4 where the control circuits generated the control signal in response to forces applied to the float.

6. A switch as in claim 5 which includes a second three terminal output device where selected terminals of each output device are connected to one another.

7. A switch as in claim 6 where the control circuits activate one output device in a first circumstance and the other in a different circumstance.

8. A switch as in claim 7 where the one output device comprises a solid state switch.

9. A switch as in claim 7 where the one output device comprises a relay.

10. A switch as in claim 9 where the other output device comprises a solid state switch.

11. A motor switching system comprising:

a housing;

first and second different load driving output switches coupled in parallel, carried in the housing, each switch has a control input;

control circuits carried in the housing, coupled to control inputs of the output switches; and an acceleration sensor coupled to the control circuits, the control circuits, responsive to a sensor output, couple a control signal to at least one control input.

12. A system as in claim 11 where the control circuits couple a first control signal to one control input for a first time interval and subsequently couple a second control signal to the other control input.

13. A system as in claim 12 where the control circuits include a programmable processor and associated, executable control programs which respond to the sensor output to couple the first control signal to the one control input for the first time interval and subsequently couple the second control signal to the other control input.

14. A system as in claim 13 which includes a switched load output, coupled to the output switches.

15. A system as in claim 14 where one switch comprises a solid state switch and the other comprises a relay.

16. A system as in claim 14 which includes a hollow, float and where the acceleration sensor is carried in the float.

17. A system as in claim 11 where one switch comprises a solid state switch and the other comprises a relay.

18. A system as in claim 11 which includes a hollow, float and where the acceleration sensor is carried in the float.

* * * * *